US005180324A

United States Patent [19]

Simmons

[11] Patent Number: 5,180,324

[45] Date of Patent: Jan. 19, 1993

[54] DOLL HAIR MAINTENANCE KIT APPARATUS

[76] Inventor: Arlene J. Simmons, P.O. Box 612, Syracuse, Ind. 46567-0612

[21] Appl. No.: 897,416

[22] Filed: Jun. 12, 1992

[51] Int. Cl.[5] ..... A63H 3/36

[52] U.S. Cl. ..... 446/296; 446/268; 446/472; 219/222; 132/112

[58] Field of Search ..... 446/14, 71, 268, 296, 446/472, 475, 483, 484, 487, 490; 219/222, 227, 244, 469; 132/111, 112, 117, 148, 232, 234, 263

[56] References Cited

U.S. PATENT DOCUMENTS

| | | | |
|---|---|---|---|
| 1,691,244 | 11/1928 | Hussey | 219/222 X |
| 1,770,943 | 7/1930 | Newton | 219/222 X |
| 1,861,040 | 5/1932 | Williams | 219/222 X |
| 2,279,708 | 4/1942 | Jakob et al. | 132/112 |
| 3,116,954 | 1/1964 | Orenstein | 446/296 X |
| 3,927,684 | 12/1975 | Lam | 219/222 X |
| 4,075,458 | 2/1978 | Moyer | 219/227 X |
| 4,221,060 | 9/1980 | Moskowitz et al. | 446/296 X |
| 5,124,532 | 6/1992 | Hafey et al. | 219/222 X |

FOREIGN PATENT DOCUMENTS

| | | | |
|---|---|---|---|
| 2533134 | 3/1984 | France | 446/296 |

*Primary Examiner*—Robert A. Hafer
*Assistant Examiner*—Sam Rimell
*Attorney, Agent, or Firm*—Leon Gilden

[57] ABSTRACT

A kit organization includes a brush assembly in cooperation with respective first, second, and third heated curling irons arranged for the curling and maintenance of doll hair. The brush assembly is arranged to accommodate heated setting wax onto a doll hair, with the curling irons of a variety of configurations to accommodate various portions of a doll's head and to effect various styling changes of hair thereto.

4 Claims, 4 Drawing Sheets

DOLL HAIR MAINTENANCE KIT APPARATUS

BACKGROUND OF THE INVENTION

1. Field of the Invention

The field of invention relates to toy apparatus, and more particularly pertains to a new and improved doll hair maintenance kit apparatus wherein the same is addressed to the maintenance and styling of doll hair.

2. Description of the Prior Art

Doll hair due to its typically course and synthetic nature and formed of thermo-setting material has heretofore been difficult in its rearrangment. The instant invention attempts to overcome deficiencies of the prior art by providing for a doll kit arranged to effect styling changes to doll hair.

Various hair curler structure has been available in the prior art as exemplified by the U.S. Pat. Nos. 4,538,630; 4,955,360; 4,952,360; 4,710,619; and 4,564,032, the prior art has heretofore failed to address the styling of hair as positioned upon dolls, with the instant invention arranged to effect styling changes to such doll hair.

SUMMARY OF THE INVENTION

In view of the foregoing disadvantages inherent in the known types of toy apparatus now present in the prior art, the present invention provides a doll hair maintenance kit apparatus wherein the same utilizes a plurality of heating and brushing components to effect styling changes to doll hair. As such, the general purpose of the present invention, which will be described subsequently in greater detail, is to provide a new and improved doll hair maintenance kit apparatus which has all the advantages of the prior art hair styling apparatus and none of the disadvantages.

To attain this, the present invention provides a kit organization including a brush assembly in cooperation with respective first, second, and third heated curling irons arranged for the curling and maintenance of doll hair. The brush assembly is arranged to accommodate heat setting wax onto a doll hair, with the curling irons of a variety of configurations to accommodate various portions of a doll's head and to effect various styling changes of hair thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved doll hair maintenance kit apparatus which has all the advantages of the prior art hair styling apparatus and none of the disadvantages.

It is another object of the present invention to provide a new and improved doll hair maintenance kit apparatus which may be easily and efficiently manufactured and marketed.

It is a further object of the present invention to provide a new and improved doll hair maintenance kit apparatus which is of a durable and reliable construction.

An even further object of the present invention is to provide a new and improved doll hair maintenance kit apparatus which is susceptible of a low cost of manufacture with regard to both materials and labor, and which accordingly is then susceptible of low prices of sale to the consuming public, thereby making such doll hair maintenance kit apparatus economically available to the buying public.

Still yet another object of the present invention is to provide a new and improved doll hair maintenance kit apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
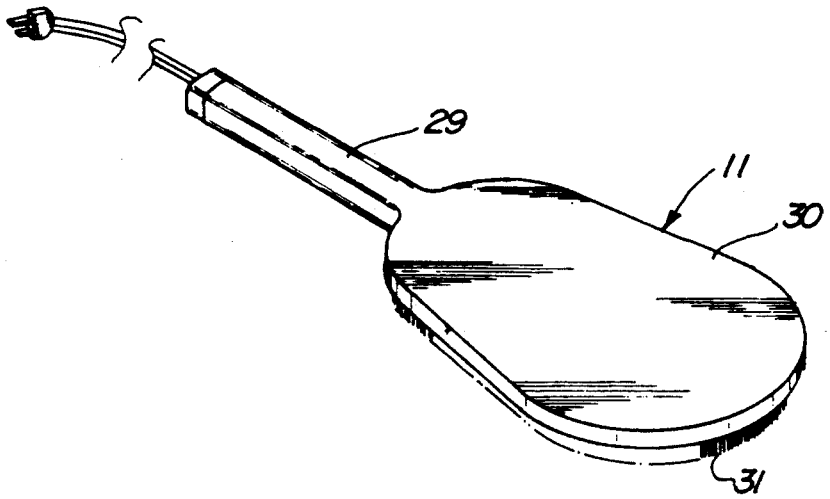
FIG. 1 is an isometric illustration of the brush member of the invention.
Figure 2:
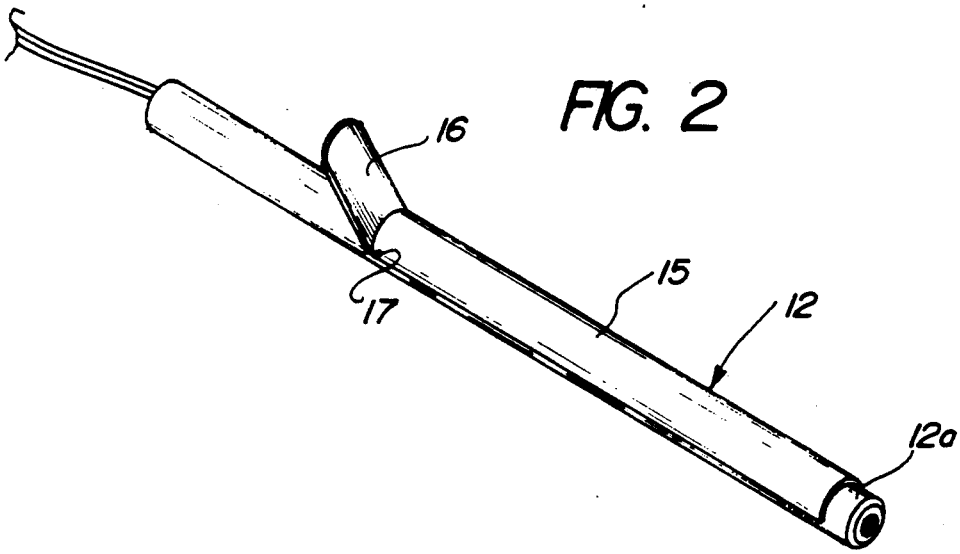
FIG. 2 is an isometric illustration of the first curling iron utilized by the invention.
Figure 3:
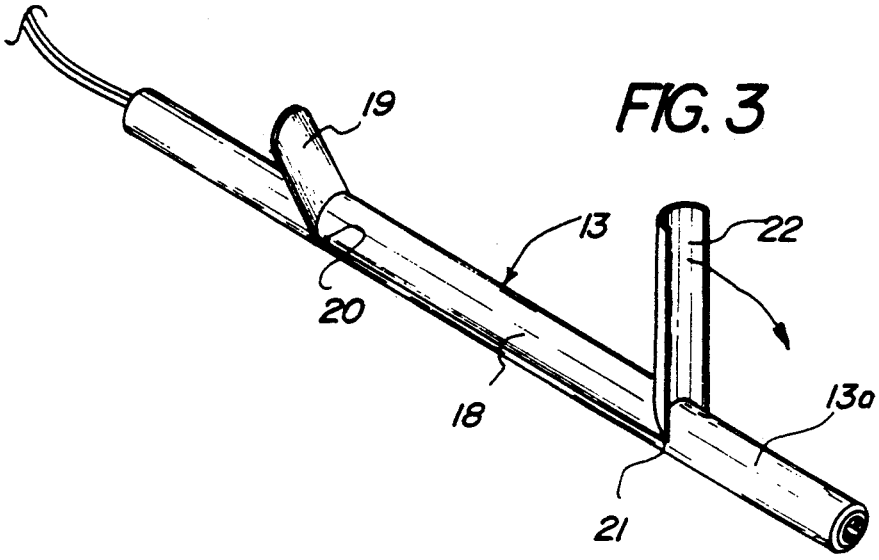
FIG. 3 is an isometric illustration of a second curling iron utilized by the invention.
Figure 4:
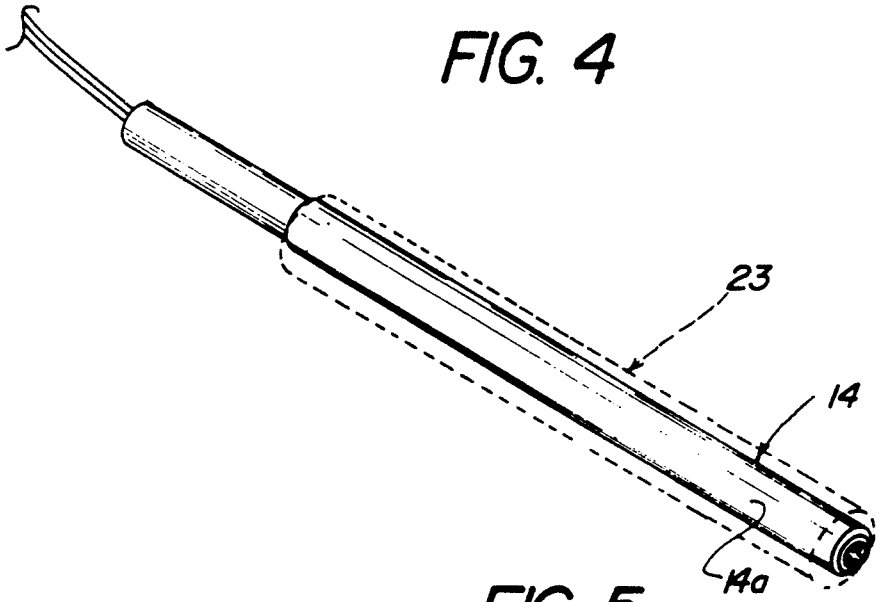
FIG. 4 is an isometric illustration of a third curling iron utilized by the invention.
Figure 5:
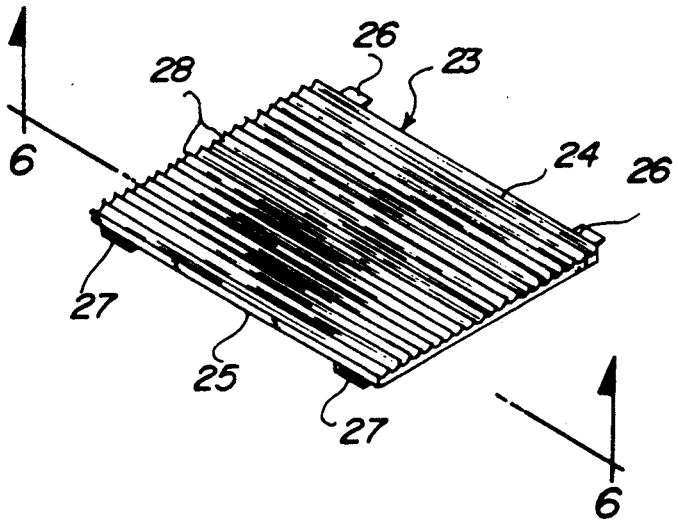
FIG. 5 is an isometric illustration of a wrap member utilized by the third curling iron structure.
Figure 6:
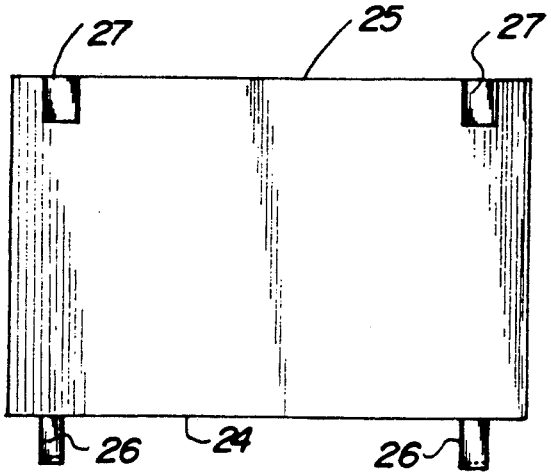
FIG. 6 is an orthographic bottom view, taken along the lines 6—6 of FIG. 5 in the direction indicated by the arrows.

With reference now to the drawings, and in particular to FIGS. 1 to 12 thereof, a new and improved doll hair maintenance kit apparatus embodying the principles and concepts of the present invention and generally designated by the reference numerals 11–42 will be described.

More specifically, the doll hair maintenance kit apparatus of the instant invention essentially comprises the use of a brush assembly 11 cooperative with a first electrical resistance heated curling iron 12, a second electrical resistance heated curling iron 13, and a third electrical resistance heated curling iron 14. The curling irons utilize conventional electrical resistance cores for heating of the curling irons, with a respective first, second, and third body 12*a*, 13*a*, and 14*a*. The first curling iron 12 includes a first arcuate cover plate 15 hingedly mounted about a first spring hinge 17 to overlie the first body 12*a*. A first handle 16 is fixedly mounted at an oblique angle relative to a rear distal end of the first cover plate 15 and adjacent the first spring hinge 17. A second curling iron arcuate cover plate 18 hingedly mounted about a second spring hinge 20 at a rear distal end of the second cover plate 18 is arranged for overlying the second body 13, and includes a second handle 19 arranged at a rear distal end of the second cover plate 18 adjacent the second spring hinge 20, with a third spring hinge 21 mounted at a forward distal end of the second cover plate 18 to accommodate a second arcuate cover extension 22 extending forwardly of the second spring hinge 20 and the second cover plate 18.

The third curling iron 14 is arranged to include a flexible cover wrap 23 having a first side 24 and a second side 25, including respective first side tabs 26 and second side sockets 27 to receive the tabs 26. In this manner, the flexible cover wrap 23 having grooves coextensively directed between the first and second sides 24 and 25 is wrapped around the third body 14*a* to enclose and secure doll hair between the cover wrap and the third body 14*a* during a curling procedure.

Figure 7:
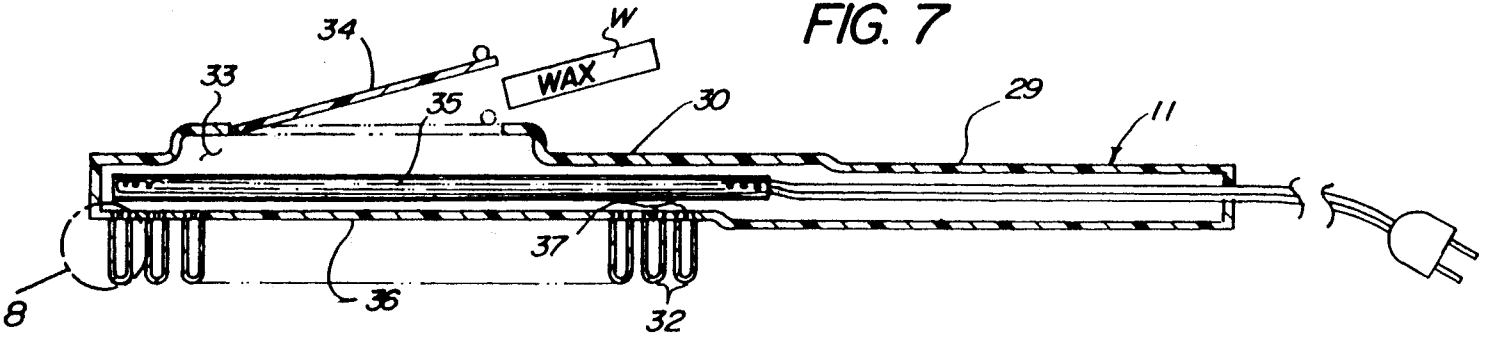
FIG. 7 is an orthographic cross-sectional illustration of a modified brush assembly utilized by the invention.
Figure 8:
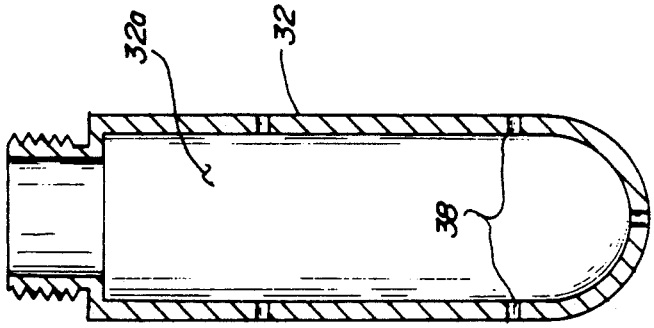
FIG. 8 is an orthographic view of section 8 as set forth in FIG. 7.
Figure 9:
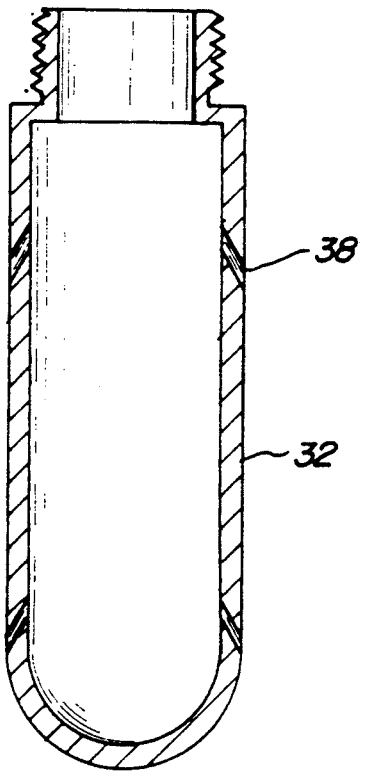
FIG. 9 is an orthographic cross-sectional illustration of a modified bristle member utilized by the brush assembly.
Figure 10:
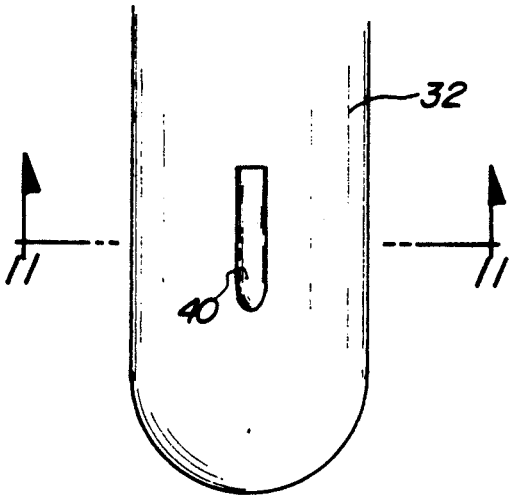
FIG. 10 is an orthographic partial view of a further modified bristle member utilized by the brush assembly.
Figure 11:
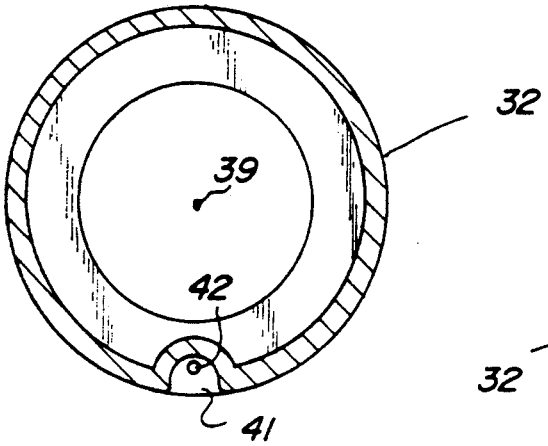
FIG. 11 is an orthographic view, taken along the lines 11—11 of FIG. 10 in the direction indicated by the arrows.
Figure 12:
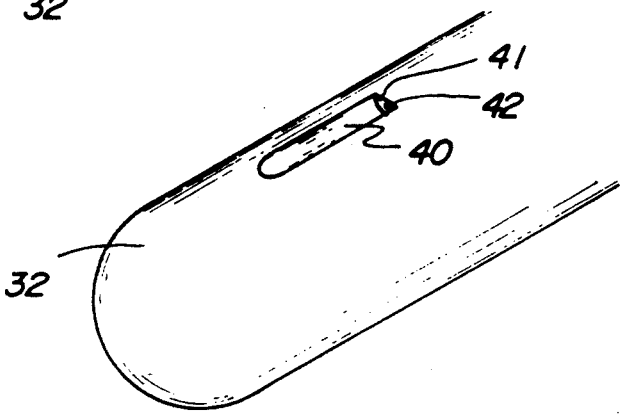
FIG. 12 is an isometric illustration of the modified bristle assembly utilized by the invention.

The brush assembly 11, as illustrated in FIG. 7, includes a handle 29, with a plurality of brush bristle members 31 extending downwardly in a generally orthogonal relationship relative to the body floor 36. The body cavity 33 includes a door 34 directed through a top wall of the body, with the electrical heating resistance coil 35 directed through the body cavity 33 over the body floor 36 and the associated bristle members 32. The FIG. 1 indicates that conventional brush bristle members 31 be mounted to a floor of a brush body 30, wherein the brush body 30, as illustrated in FIG. 7, is arranged to accommodate the dispensing of a setting wax bar "W" within the body cavity 33 accessed through the door 34. Melting of the wax bar directs such wax through body floor apertures 37 into the bristle members 32 that each include a plurality of bristle outlet ports 38, such as illustrated in FIG. 8, orthogonally directed through the wall of the bristle from the bristle cavity 32*a* within each bristle member 32. FIG. 9 illustrates the outlet ports 38 arranged at an oblique angle relative to the bristle wall. The FIGS. 10–12 indicate modified bristle structure having at least one, and preferably a plurality, of bristle wall grooves 40 within each bristle arranged generally parallel to an axis 39 of each bristle member 32. A bristle wall groove 40 includes a groove top wall 41 at an upper distal end of the groove arranged in a parallel relationship relative to the floor 36, with the groove top wall 41 having an exit port 42 for release of wax therethrough onto a doll's hair. The use of the wax in complementary association with the curling iron structure is indicated in the FIGS. 2–6 and provides for the control and manipulation of doll hair to refashion such doll hair by individuals for amusement and entertainment.

The orientation of the bristle wall grooves and the exit ports 42 directed through the groove top wall 41 minimize the plugging and projection of hair within the top wall exit ports 42 to provide for a continuous flow of the melted wax through the exit ports 42. This advantage is directed over the outlet ports 38 that either are in an orthogonal or oblique orientation relative to the bristle body wall permitting hair to be directed therewithin to temporarily at least permit a plugging of the exit ports.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A doll hair maintenance kit apparatus, comprising, a brush assembly, and a plurality of curling irons to include a first heated curling iron and a second heated curling iron, the brush assembly includes a handle having a brush body, the brush body including a brush body top wall and a brush body bottom wall, and a matrix of bristles extending through the brush body bottom wall, and the first curling iron includes a first curling iron arcuate cover plate, and a first cylindrical body, with the first cover plate including a first spring hinge positioned at a rear distal end of the arcuate plate hingedly mounting the first cover plate to the first cylindrical body, and a first handle mounted to the rear distal end of the first cover plate at an oblique angle relative to the first cover plate, the second curling iron including a second curling iron arcuate cover plate, and a second spring hinge at a rear distal end of the second cover plate, and a second handle fixedly mounted at an oblique angle to the second cover plate adjacent the second spring hinge, and a third spring hinge mounted to a forward distal end of the second cover plate, a second arcuate cover extension extending beyond the second cover plate hingedly mounted to the second cover plate at the third spring hinge.

2. An apparatus as set forth in claim 1 wherein said plurality of curling irons includes a third curling iron, wherein the third curling iron includes a third cylindrical body, and further includes a flexible cover wrap securable in an encircling relationship about the third body, with the third cover wrap including a first side spaced from a second side, and a plurality of grooves extending coextensively between the first side and the second side, and the first side including first side tabs projecting orthogonally beyond the first side, and the second side including second side sockets, with the second side sockets oriented to receive the first side tabs when the cover wrap is secured about the third body.

3. An apparatus as set forth in claim 2 wherein the brush assembly top wall includes a top wall door and the bottom wall includes a plurality of apertures, wherein each aperture is positioned over one of said bristles, and each bristle includes a bristle cavity within each bristle in fluid communication with the said at least one aperture, and a wax bar arranged for directing into the brush body through the door, with the brush body including electrical resistance heating coil directed coextensively through the brush body to effect melting of the wax bar within the brush body.

4. An apparatus as set forth in claim 3 wherein each bristle includes at least one bristle wall groove and the bristle wall groove includes a groove top wall oriented parallel to the brush body bottom wall, and the groove top wall includes an exit port to direct fluid flow therethrough.

* * * * *